US006244841B1

(12) United States Patent
Schofield et al.

(10) Patent No.: US 6,244,841 B1
(45) Date of Patent: Jun. 12, 2001

(54) VACUUM PUMPS

(75) Inventors: Nigel Paul Schofield, Horsham; Michael Morris, Shoreham; Peter Hugh Birch, Horsham, all of (GB)

(73) Assignee: The BOC-Group, plc, Windlesham (GB)

( * ) Notice: Subject to any disclaimer, the term of this patent is extended or adjusted under 35 U.S.C. 154(b) by 0 days.

(21) Appl. No.: 09/065,505

(22) Filed: Apr. 24, 1998

(51) Int. Cl.[7] ..... F01C 19/00
(52) U.S. Cl. ..... 418/104; 418/206.6
(58) Field of Search ..... 418/104, 206.6

(56) References Cited

U.S. PATENT DOCUMENTS 3,421,769 * 1/1969 Boop et al. ..... 418/104 X
4,515,512 * 5/1985 Hertell et al. ..... 418/104 X
4,834,634 * 5/1989 Ono ..... 418/104 X
5,046,934 * 9/1991 Berges ..... 418/206.6 X
5,201,647 * 4/1993 Niemiel et al. ..... 418/102
5,490,771 * 2/1996 Wehber et al. ..... 418/104

FOREIGN PATENT DOCUMENTS 0 649 997 * 4/1995 (EP) .
680001 * 10/1952 (GB) .
05296171 * 4/1992 (JP) .
94 15100 * 7/1994 (WO) .

* cited by examiner

*Primary Examiner*—Hoang Nguyen
(74) *Attorney, Agent, or Firm*—Salvatore P. Pace

(57) ABSTRACT

A vacuum pump comprising a pump chamber having an inlet and an outlet and through which gas from an enclosure connectable to the inlet can be pumped to a pump exhaust. At least one rotor, adapted for high velocity rotation, is provided within the chamber and mounted on a shaft extending from the chamber and to a pump gearbox substantially isolated from the chamber by means of a shaft seal associated with the shaft. The shaft seal is of a close tolerance but non-contact design. During use of the pump, gas pressure in the vicinity of the shaft seals and arising from the changeable gas pressures associated with operation of the pump rotor is buffered.

6 Claims, 3 Drawing Sheets

VACUUM PUMPS

BACKGROUND OF THE INVENTION

This invention relates to vacuum pumps and, more particularly to oil-free or dry mechanical vacuum pumps.

Oil free or dry vacuum pumps, ie those having an oil free swept volume are well known and are extensively used to evacuate enclosures in clean environments such as those found in the semiconductor industry.

Typical pumps of this type can comprise a chamber having one or, more commonly, a plurality of, for example four, pumping stages, each containing inter-meshing pairs of rotors to effect a pumping action and urge gas being evacuated from a pump inlet, through the pumping stages in turn, and subsequently urge the gas out of the pump through a pump outlet.

One rotor of each pair is attached to a first shaft passing through the stage(s) with the second rotor of each pair being attached to a second shaft also passing through the stage(s). One of the shafts is driven by a motor and the other is usually driven synchronously in the opposite direction by means of timing gears attached to the respective shafts.

The rotors of each pair are commonly of the "Roots" type or of the "Northey" (or "Claw") type, both well known per se in the vacuum pump industry. In multi-stage pumps, each stage may possess the same type of rotor pairs or there may be different types of rotor pair in different stages. For example, one commercial vacuum pump sold by the Applicants comprises a first stage possessing a "Roots" type rotor pair and the second, third and fourth stages all possessing "Claw" type rotor pairs.

Alternative pumps of this type are regenerative pumps in which a disc shaped rotor attached to a shaft is driven at high speed by an electric motor usually positioned about the shaft. The rotor has a plurality of teeth on its edge or arrayed on one or both of its faces and, in use, the teeth rotate within passageways in a pump stator and urge molecules of gas being pumped through the passageways. At one place in the passageway, a stripper deflects the molecules in to the next passageway or to a pump exhaust.

A gearbox is usually positioned at the driven end of the shaft(s) containing the shaft end(s), bearings within which the shaft(s) rotate, any timing gears and commonly the motor positioned about the driven shaft. Further bearings may optionally be present at the opposite (non-driven) ends of the shaft(s).

For reasons of cleanliness and non-contamination of the gases being pumped to avoid in particular the possibility of transfer of such contamination back in to the enclosure being evacuated, the oils and/or greases necessarily associated with the gearbox need to be contained and isolated within the gearbox.

For the same reasons, the enclosed gearbox is normally positioned adjacent the pump stage associated with the pump outlet. However, for practical engineering reasons, the gearbox cannot be fully isolated, in particular because of the slight leakage always associated with shaft seals which need to be present about the shafts and attached to a head plate between the gearbox body and the pump stages. This is particularly true for seals of the non-contacting type which are often used to minimise power consumption or because the speed of shaft rotation is too high for contact seals such as lip seals.

As such, a common problem with some designs of vacuum pump is that the gearbox shaft seals at the exhaust end of the pump tend to be exposed to different pressures depending on the pump duty. The seal pressure is typically some intermediate pressure between that of the inlet and outlet of the final pump chamber. During pump "roughing" condition this will tend to be greater than atmospheric pressure, whereas at ultimate vacuum condition this will tend to be lower than atmospheric pressure. This can lead to a certain flow of gas past the shaft seals, ie in to or out of the gearbox respectively. This can be particularly the case with non-contacting shaft seals where this may have the undesirable effect of carrying contamination in to the gearbox and oil/lubricant mist out of the gearbox.

SUMMARY OF THE INVENTION

The invention is concerned with the provision of a vacuum pump in which such a problem is minimised and generally overcome.

In accordance with the invention, there is provided a vacuum pump comprising a pump chamber having an inlet and an outlet and through which gas from an enclosure connectable to the inlet can be pumped to a pump exhaust, the chamber possessing at least one rotor adapted for high velocity rotation within the chamber and mounted on a shaft extending from the chamber and in to a pump gearbox substantially isolated from the chamber by means of a shaft seal associated with the shaft, wherein the shaft seal is of a close tolerance but non-contact design and means are provided to buffer, in use of the pump, the gas pressure in the vicinity of the shaft seals from the changeable gas pressures associated with operation of the pump rotor.

The shaft seal must be of a close tolerance, non-contact design. The use of one or more metal rings held within grooves in the pump (stator) body which allow for limited movement—radial and axial—in the grooves and with an internal diameter only very slightly larger than the external diameter of the shaft are useful in this respect. In use of such seals, the metal ring(s) is centred about the shaft in a non-contacting manner.

Alternatively, the shaft seal may be one having a lip held in the pump (stator) body with its lip in close tolerance proximity (but non contacting) to a rotating part or vice-versa.

The invention is based on the surprising discovery that the use of such a close tolerance but non-contact seal coupled with the means to buffer the gas pressure in the vicinity of the seal allows for an effective seal without the need to establish a specific gas flow (or gas circulation) in to the seal area to ensure that the oil is retained in the gear box.

Pumps of the invention can comprise a single stage within the pump chamber or, more commonly, a plurality of individual stages within the chamber in a manner known per se with the first stage being adjacent the chamber inlet and the final stage being adjacent the chamber outlet which is itself connected to the pump exhaust. Each stage may posses a single rotor but more usually possesses a pair of rotors as described above and is separated from its adjacent stage or stages with ports and passageways linking the stages so that gas can be pumped from the chamber inlet to the chamber outlet in sequential order through the stages.

The gas pressure buffering means can comprise a pressure equilibrium volume or "plenum" volume. The plenum volume is generally connected to the gas exhaust line of the pump, thereby ensuring a substantially damped and therefore constant pressure at the shaft seals in order to prevent a significant flow of gas or vapour in to or out of the gearbox. Advantageously, the plenum volume is generally of annular shape and positioned about the shaft(s).

In preferred embodiments of the invention, the gas pressure buffering means is linked to the pump exhaust, preferably directly and not via a pumping chamber.

This advantageously takes the form of a pressure buffering equalisation line linking the pressure buffering means, for example a plenum chamber, and the exhaust. Preferably such a pressure equalisation line can be formed in a head plate member between the pump chamber(s) and the gearbox.

It is generally advantageous for the pressure buffering means, preferably a plenum volume, to be present between two seals of the close tolerance, non-contacting type, both seals generally being positioned on either side of the pressure buffering means and within the head plate area of the pump. In such embodiments, a pressure equalisation line can link the pressure buffering means with the pump exhaust, thereby substantially isolating the equalisation line from the pump chamber(s).

Such embodiments are particularly relevant to vacuum pumps having a single "Claw" stage or to ones having a "Claw" stage at the chamber outlet as the outlet from a "Claw" stage tends to be in an axial direction from the rotors and may therefore have a greater effect on gas pressure changes in the head plate area in contrast, for example to a "Roots" stage where the chamber outlet tends to be in a radial direction relative to the rotors.

A shaft seal system for vacuum pump of the invention can also include means to urge oil in the direction of the pump gear box linked to a gas pressure by-pass means. Preferably, the oil urging means comprises a conical member associated with the pump shaft and associated seal such that any oil present in the head plate area is urged towards the gear box by centrifugal forces. The by-pass means is preferably a volume defined on the pump side of the oil urging means with a by-pass line to the gear box; this may be present as a bore or bores in the rotor shaft and linking the pump side of the oil urging means, with the interior of the gear box coupled preferably with a filter to prevent the flow of oil through the bore(s) and in to the vicinity of the oil urging means. Such a by-pass channel allows gas to be evacuated from the gearbox without the danger of its being pulled through the oil seal together with any entrained oil. Such evacuation might happen if the exhaust pressure dropped for some reason.

In preferred embodiments, the pump possesses a close tolerance, non-contact shaft seal together with, if appropriate, a rotatable conical element in the pumphead plate and together with gas pressure buffering means which includes a pressure equalisation bore in the shaft linking the head plate area with the gear box interior and including a filter to prevent flow of oil to the head plate.

Preferably the filter is a spinning filter attached to the base of the shaft and covering the inlet to the bore of the type which can coalesce or otherwise trap any oil impinging on it and eject it from its surface/pores by centrifugal forces.

In another preferred embodiment of the invention, the plenum volume is formed about one or both of the shafts on the pump chamber side of a shaft seal of the close tolerance, non-contact type and within a gear box body portion adjacent the chamber, or within a chamber/gear box head plate separating member, and linking the volume with the pump exhaust by means of one or more grooves in the gear box body. Such an embodiment is particularly relevant to vacuum pumps having a single "Roots" stage or to ones having a "Roots" stage at the chamber outlet as the outlet from a "Roots" stage tends to be orientated radially from the periphery of the rotors (as opposed to "Claw" stages whose outlet tends to be orientated axially from the rotors).

In certain circumstances but without detracting from the general principle of the invention for a "non-flowing" arrangement, it may be advantageous to incorporate a filter in the pressure equalisation line and to provide means to draw gas from the pump exhaust, or from the external atmosphere, or from a supply of clean inert gas such as nitrogen in to the vicinity of the shaft seals and in to the plenum volume to effect a flow of filtered and/or dried gas across the shaft seals.

The means to effect the gas flow can conveniently be a viscous drag or thread pump element on the relevant part of the shaft. The flow of gas thus effected can act to keep the main process gas from entering the gear box and, in certain circumstances, can obviate the need for a flow nitrogen purge gas around the shaft seal area of the pump.

BRIEF DESCRIPTION OF THE DRAWINGS

For a better understanding of the invention, reference will now be made, by way of exemplification only, to the accompanying drawings, in which.

DETAILED DESCRIPTION

Figure 1:
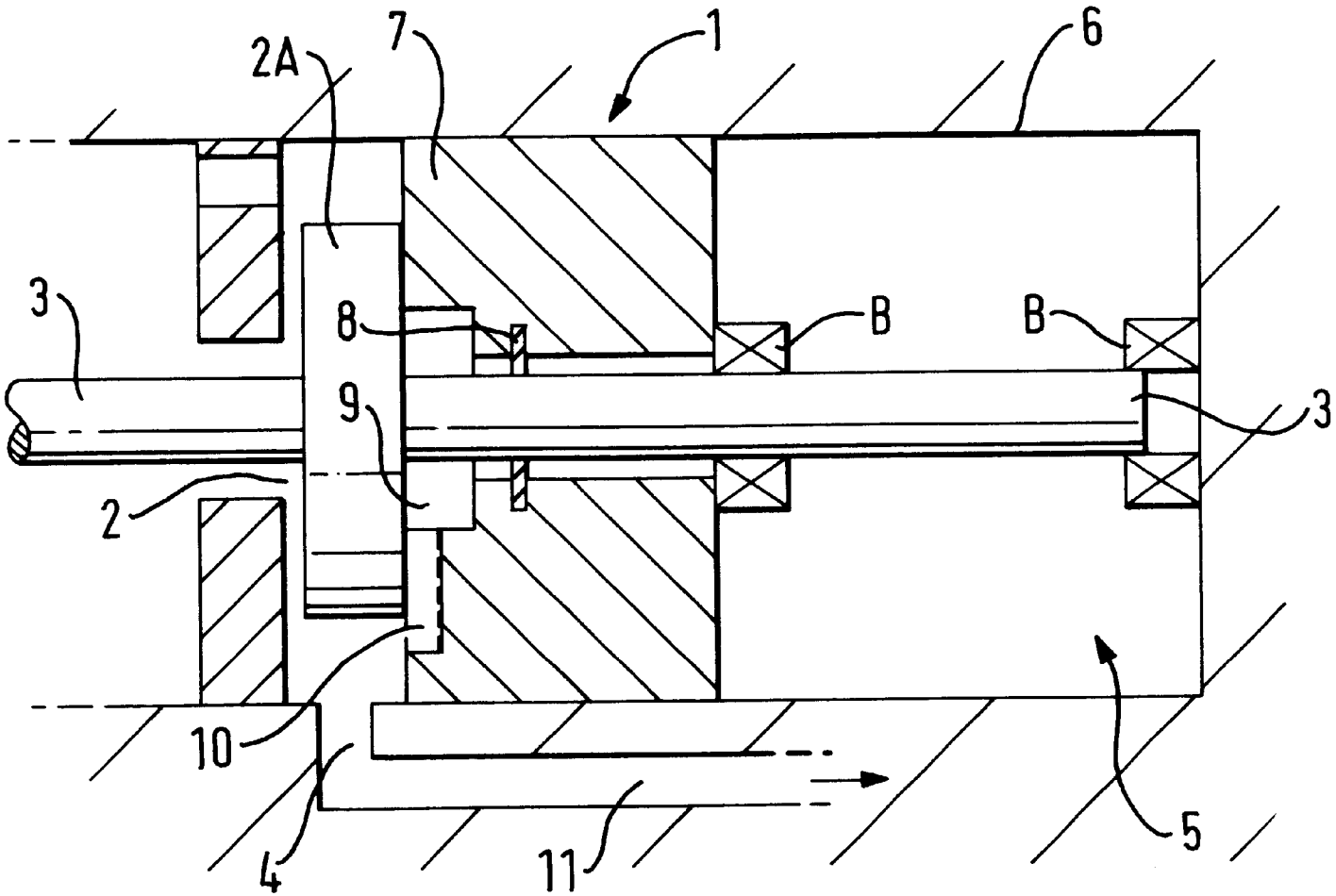
FIG. 1 shows a schematic cross sectional view through a vacuum pump of the invention.

With reference to the drawings and initially to FIG. 1 in particular, there is shown a vacuum pump 1 of the invention comprising a pumping chamber having four individual pumping stages of which only the fourth stage 2 is shown in FIG. 1. Each stage has a pair of intermeshing "Roots" profile rotors 2A therein, one rotor of each pair being attached to a first shaft 3 which is mounted within bearings and the other rotor of each pair is attached to a second shaft; the second shaft and its attached rotors are not visible in the drawings as they are hidden by the first shaft and its attached rotors.

The pump chamber has an inlet (not shown) in to the first pump stage and an exhaust 4 connected directly to the outlet of the fourth pump stage 2 and porting and passageways are provided to allow gas being pumped to enter in to the pump inlet and pass out of the pump exhaust 4 via the four pumping stages in sequential order in a manner well known and documented.

Adjacent the pump fourth stage 2 is a pump gear box generally indicated at 5 and having a hollow body 6 including a body portion (or head plate) 7 through which the shafts 3 pass.

A motor (not shown) is mounted about the shaft 3 and is adapted to drive the shaft 3 at high speed about its longitudinal axis within two bearings B as shown. Timing gears (not shown) link the driven shaft 3 to the second shaft (not shown) to drive the second shaft synchronously at the same speed as the first shaft 3 but in the opposite direction. The gear box 5 inevitably contains lubricating oils and the atmosphere therein is laden with vapours therefrom.

A shaft seal 8 held within the body portion 7 is therefore present about each of the shafts 3 to contain the oil vapours in the gear box and generally to minimise any escape of oil in to the vicinity of the final pumping stage 2 in order to preserve the cleanliness of the pump chamber. The seal 8 comprises a metal ring held in a groove in the body portion 7 and being of the close tolerance, non-contact type with regard to the shaft 3 external dimensions.

As explained above, there remains the possibility of a certain amount of such oil vapours escaping past the shaft seals 8 due to variations in the pressure of gas being expelled from the final pumping stage 2. In accordance with the invention, a plenum volume 9 of annular shape about the shaft 3 is formed in the body portion 7 on the side of each shaft seal 8 remote from the gear box interior. The plenum volume is of annular shape (being formed in the body portion 7) and is linked by channels 10 associated with each shaft 3 to the exhaust line of the pump, in this case the outlet 4 of the fourth stage 2 which is itself directly linked to the pump exhaust 11.

The presence of the plenum volume 9 has the effect of buffering or damping any pressure difference of the gas in the area of the shaft seal 8, thereby minimising and preventing any flow of gas in to or out of the interior of the gear box 5.

Figure 2:
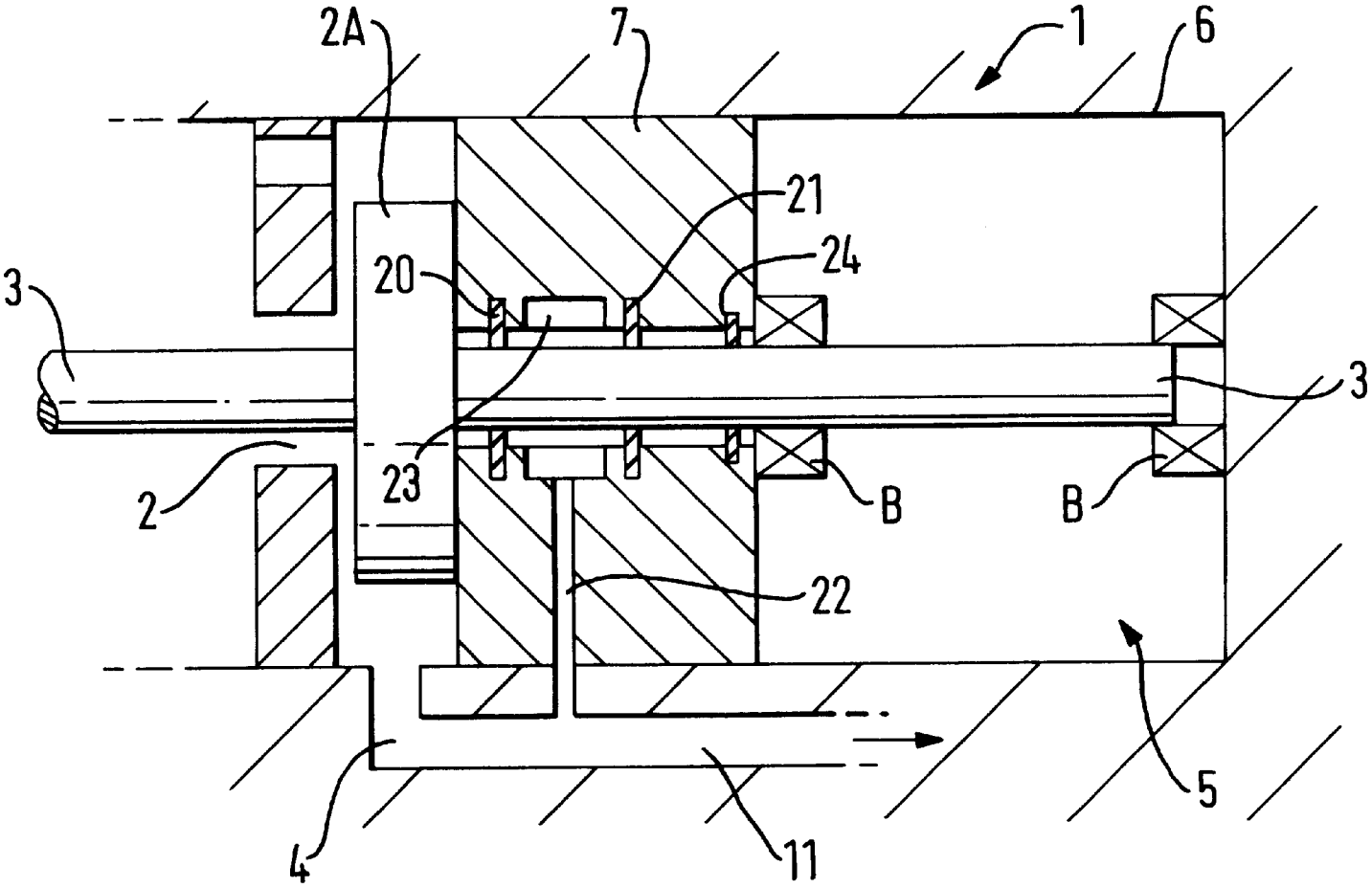
FIG. 2 shows a schematic cross sectional view through a further vacuum pump of the invention incorporating a gas pressure buffering means in particular.

Turning to FIG. 2, a further vacuum pump of the invention is shown again with four pumping stages all having a Claw or Roots (as shown) rotor profile for each of the four pairs of rotors in the respective stages. Again only one of the rotors 2A of the fourth stage is shown.

In general all reference numerals are the same as shown in FIG. 1. However, the shaft seal 8 of FIG. 1 is replaced in the embodiment of FIG. 2 with a pair of similar type shaft seals 20,21 on each shaft, held within the body portion 7 and between which is positioned a pressure equalisation line 22, again for each shaft, linking the shaft seal area with the pump exhaust 11.

The presence of a plenum volume 23 again if annular shape about the shaft 3 effects pressure damping or buffering of the gas pressure in the vicinity of the shaft seal 21 and the changeable gas pressures associated with operation of the rotors.

The presence of the second shaft seal 20 restricts the flow of gas to or from the plenum volume via the shaft clearances, so minimising pressure changes for a given flow of equalisation gas through channel 22.

A further close tolerance non-contacting lip seal 24 is also held in the head plate 7 with an internal diameter substantially matching the external diameter of the shaft 3 in order to provide an extra barrier to the escape of any oil, etc from the gear box 5. This can be supplemented by the presence of a conical surface, for example on the shaft 3 which would urge any oil which might be in the head plate area back towards the gear box 5 by centrifugal forces associated with the spinning shaft 3.

Figure 3:
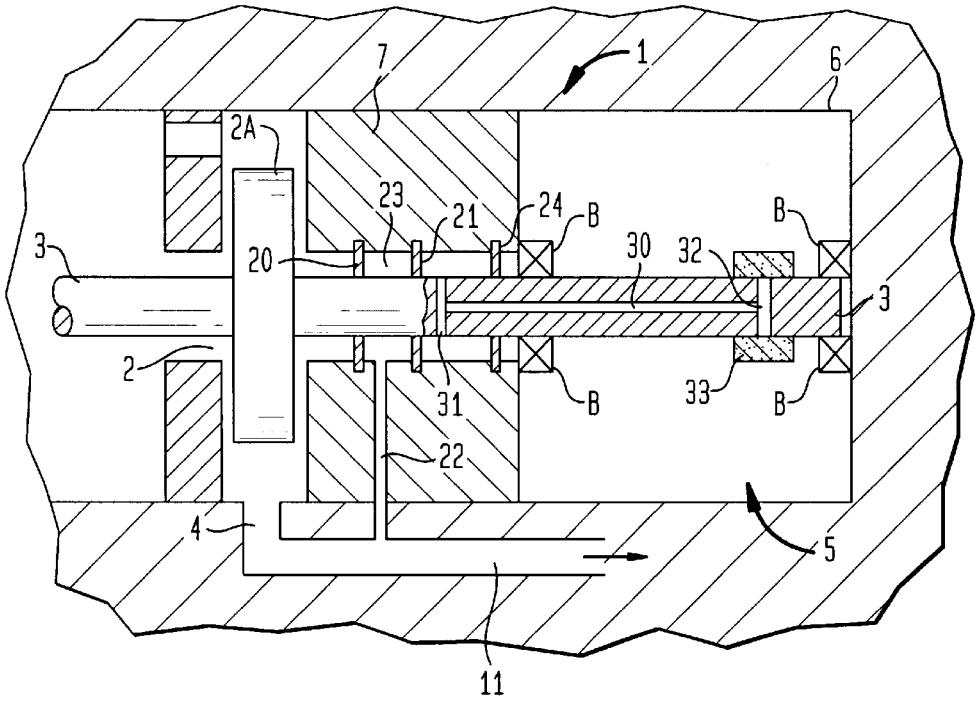
FIG. 3 shows a schematic cross sectional view through a further vacuum pump of the invention incorporating a filtered by-pass line.

Turning to FIG. 3, a further pump of the invention is shown again with four pumping stages each having a pair of intermeshing "Roots" or "Claw" profile rotors with again only one of the Roots rotors 2A of the fourth stage shown.

In general, all reference numerals are the same as in FIG. 2. However, in this embodiment the shaft 3 has a central axial bore 30 linked at each end of the bore 30 to a number of radial bores 31, 32 linking the bore 30 to the outer surface of the shaft 3 at each end.

An annular filter element 33 is fixed about the shaft 3 such that any communication between the interior of the gearbox 5 and the bore 30 via the bores 31, 32 is via the filter element. The filter may be any type which prevent the flow of oil, etc droplets into the bores 31, 32 but which allows for the flow of air therethrough whilst the filter is spinning with the shaft 3. It may be a filter of the coalescing type.

The presence of the bores 30, 31, 32 therefore provides a communication between the interior of the gear box 5 and the area of the head plate 7 on the gear box side of the plenum volume 23, thus allowing gas to be evacuated from the gear box without pulling it through the oil seal 24.

As described above with reference to FIG. 2 in particular, the lip seal 24 helps in preventing the migration of any oil towards the head plate area 7 from the gear box 5. The seal 24 can be supplemented in this function by the presence of a conical surface, for example on or associated with the shaft 3 which would urge any oil which might be present in the head plate area towards the gear box 5 by centrifugal forces associated with the spinning shaft 3.

We claim:

1. A vacuum pump comprising:

a pump exhaust;

a pump chamber having an inlet and an outlet and through which gas from an enclosure connectable to the inlet can be pumped to said pump exhaust;

at least one rotor adapted for high velocity rotation within the chamber;

the at least one rotor mounted on a shaft extending from the chamber and into a pump gearbox;

a shaft seal to isolate said pump gear box from said chamber, the shaft seal associated with the shaft, and of a close tolerance but non-contact design; and means for buffering gas pressure in the vicinity of the shaft seal from the changeable gas pressures associated with operation of the pump rotor, said means comprising a plenum volume and a gas pressure equilisation means.

2. The vacuum pump according to claim 1 in which the shaft seal comprises one or more metal rings held within grooves in the pump body.

3. The vacuum pump according to claim 1, wherein the plenum volume and the gas pressure equilisation means are in flow communication with the gas exhaust line of the pump.

4. The vacuum pump according to claim 1 in which the plenum volume is of annular shape and positioned about the shaft.

5. The vacuum pump according to claim 1 in which said plenum volume and the pressure equalisation means are situated between two seals of the close tolerance, non-contacting type.

6. The vacuum pump according to claim 1 further comprising a filtered gas by-pass line incorporating a spinning filter.

* * * * *